US005816276A

United States Patent [19]

Seidel et al.

[11] Patent Number: 5,816,276

[45] Date of Patent: Oct. 6, 1998

[54] SELF-OPENING AND/OR SELF-CLOSING UMBRELLA

[75] Inventors: Joachim Seidel, Solingen; Klaus Stiller, Langenfeld, both of Germany

[73] Assignee: Kortenbach Verwaltungs- und Beteiligungsgesellschaft mbH & Co, Solingen, Germany

[21] Appl. No.: 651,682

[22] Filed: May 21, 1996

[30] Foreign Application Priority Data

Mar. 14, 1996 [DE] Germany ..... 196 09 932.3

[51] Int. Cl.[6] ..... A45B 25/14

[52] U.S. Cl. ..... 135/24; 135/98; 135/20.3; 135/25.4; 135/22

[58] Field of Search ..... 135/98, 15.1, 19.5, 135/20.3, 21, 22, 23, 24, 25.33, 25.4, 28, 37, 38, 39, 42

[56] References Cited

U.S. PATENT DOCUMENTS

| | | | |
|---|---|---|---|
| 2,224,882 | 12/1940 | Peok | 135/98 |
| 2,483,585 | 10/1949 | Lewis | 135/98 X |
| 2,721,569 | 10/1955 | Militano | 135/203 |
| 3,171,418 | 3/1965 | Meyer | 135/25.4 |
| 4,011,881 | 3/1977 | Becher | 135/98 X |
| 4,041,966 | 8/1977 | Sakurai | 135/22 |
| 4,763,679 | 8/1988 | Lerch | 135/20.3 |
| 4,813,492 | 3/1989 | Haines | 135/20.3 X |
| 5,174,319 | 12/1992 | Chou et al. | 135/20.3 |
| 5,213,122 | 5/1993 | Grady, III | 135/20.3 |
| 5,390,686 | 2/1995 | Lin et al. | 135/20.3 X |

*Primary Examiner*—Wynn E. Wood
*Attorney, Agent, or Firm*—Henry M. Feiereisen

[57] ABSTRACT

An umbrella includes an elongated stick for connecting a handle to a canopy, and an elastic-driven mechanism for controlling operation of the canopy between an open end position and a closed end position by moving a slide mechanism, which is linked to the canopy, relative to the stick. The elastic is set under tension when the canopy occupies one of the end positions to bias the slide mechanism so that the canopy seeks the other end position. A latch releasably locks the slide mechanism when the canopy occupies the one end position.

11 Claims, 6 Drawing Sheets

SELF-OPENING AND/OR SELF-CLOSING UMBRELLA

BACKGROUND OF THE INVENTION

The present invention refers to a self-opening and/or self-closing umbrella, and in particular to an automatic umbrella of a type having a stick for supporting a canopy and a slide mechanism for controlling operation of the canopy between an open end position and a closed end position, and a latching unit for releasably locking the slide mechanism when the canopy occupies an position.

Automatic umbrellas of this type with incorporated self-opening or self-closing mechanism for the canopy as well as telescopic arrangements of the stick are known from various publications, for example U.S. Pat. Nos. 594,135, 1,067,435, 1,207,649, 2,906,277, 3,016,910, and 4,986,294.

Typically, the self-opening or self-closing mechanism of conventional umbrellas is still generally based on the use of helical springs of steel which exert the necessary pushing force or pulling force, despite their known drawbacks in connection with manufacturing and use, such as e.g. the consistently high susceptibility to corrosion, the generation of scratching and screeching noises, the relatively great dimensions in longitudinal and transverse directions to effect the required force in order to push the canopy into the open position or to pull the canopy to the closed position. The substantial dimensions of the springs leads to relatively heavy umbrellas, and their installation within the existing rather limited space is always difficult to manage. Further drawbacks of helical springs include their limited stretch capability, which typically is restricted to a maximum of 100%, and the inability of steel springs to reverse the direction of their travel path or within the tight space inside the stick. Springs can thus be used only either as compression springs or tension springs in order to effect the opening function or the closing function.

SUMMARY OF THE INVENTION

It is an object of the present invention to provide an improved automatic umbrella obviating the afore stated drawbacks.

This object, and others which will become apparent hereinafter, are attained in accordance with the present invention by providing an umbrella which includes an elastic-driven mechanism in form of an elastic for moving the slide mechanism relative to the stick to thereby control operation of the canopy between the open and closed end positions, wherein the elastic is under tension when the canopy occupies one end position to bias the slide mechanism and thereby the canopy to seek the other end position.

The provision of an elastic results in a universally usable, very simple, wear-resistant and inexpensive drive mechanism which can be easily and inconspicuously incorporated within the umbrella and is equally applicable for self-opening umbrellas as well as self-closing umbrellas. The elastic is much lighter than comparable steel springs so that also the overall weight of the umbrella can be appreciably decreased. The drawbacks of conventional springs, as set forth above, are eliminated through use of an elastic-driven mechanism according to the present invention. In particular, with respect to stretching capability does the elastic-driven mechanism show its superiority over conventional metallic springs. While a conventional metallic spring may be stretched at best by approximately 100%, the elastic-driven mechanism according to the present invention exhibits a stretching capability of up to 700%, i.e. sevenfold. As a result, the configuration and dimensions such as length and cross-section, initial tension, effective stroke and exerted force can be easily suited to prevailing installation conditions. The elastic may have a wider or narrower cross-section, or may be of shorter or longer length and even may exhibit excessive length beyond the length of the stick when requiring e.g. extremely long strokes of the slide mechanism for controlling the canopy. In these circumstances, the elastic can be installed in tight spaces of the stick and routed smoothly to the outside for reversal of the traveling direction even at a tight curve radius, without adversely affecting the overall stability and operation. The reversal of the traveling direction is especially suitable for dual operation as opening and closing mechanism.

Preferably, the elastic is made of a multi-fibrous latex-rubber fabric in form of a rubber cable sheathed by a textile fabric. Alternatively, the elastic may also be provided in the form of a hose-like latex structure.

According to one embodiment of the present invention, the elastic-driven mechanism includes an elastic extending within the stick and having one extremity secured to the upper or lower end of the stick and another extremity secured to the slide mechanism. Preferably, the slide mechanism includes a slide element extending within the stock to form with the stick a telescopic arrangement, with the elastic being stretched between the stick and the slide element.

According to another embodiment of the present invention, the slide mechanism has a runner which is movable outside along the stick, with the elastic-driven mechanism including a pulley positioned at one end of the stick, whereby the elastic is stretched between the other end of the stick and the runner via the pulley. Advantageously, the elastic is formed with a prolongation in form of a rope or thread exhibiting tensile strength for connecting the elastic from the pulley to the runner.

According to still another embodiment of the present invention, the elastic-driven mechanism is combined with a preceding reduction gear in form of a block and tackle, with the elastic being stretched between the stick and the runner via the reduction gear and having one extremity secured to a first pulley and another extremity secured to one end of the stick, with the first pulley being positioned at the other end of the stick and traveling within the stick during operation of the elastic for moving the canopy between the open and closed positions. The block and tackle type reduction gear includes a second pulley which is securely fixed to the stick and reverses the traveling direction of the rope from inside the stick to the runner, with the first pulley being geared down in relation to the second pulley.

Preferably, each end of the elastic can be suitably secured by a sleeve which is received within the stick or slide element and formed with a crimped ledge, and a squeeze ring which is press-fitted onto the elastic in close proximity of its free end and bears against the crimped ledge.

According to another feature of the present invention, the slide mechanism is held in place by a latch when the canopy occupies one end position in which the elastic is set under tension to store the required energy for operating the canopy, with the latch being formed with a hooked end locking onto the stick and a push-lever for enabling a disengagement of the hooked end from the stick.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
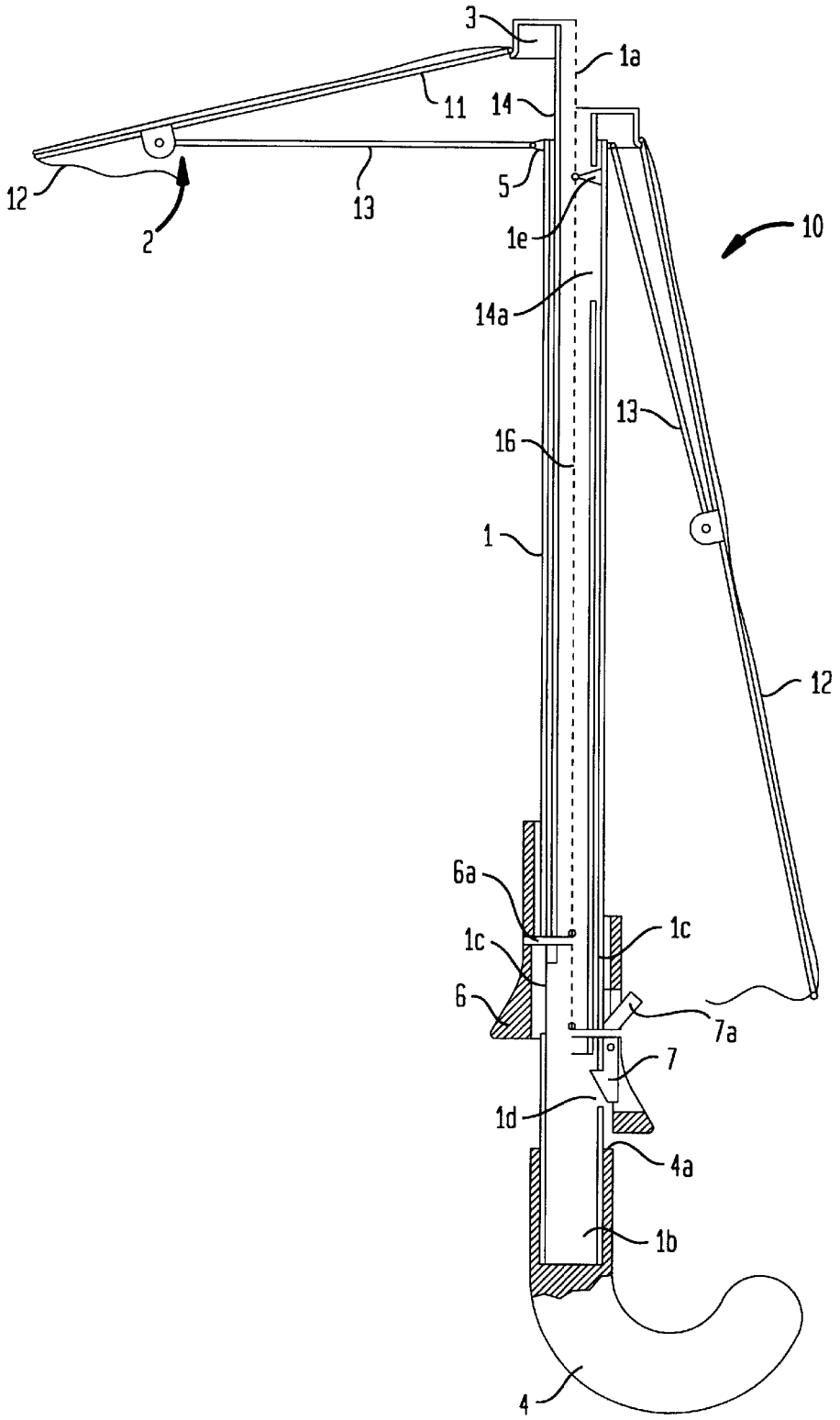
FIG. 1 is a partially sectional view of one embodiment of an umbrella according to the present invention of the self-opening type, illustrating on the left hand side the umbrella with opened canopy and on the right hand side with closed canopy.

Throughout all the Figures, the same or corresponding elements are generally indicated by same reference numerals.

Turning now to the drawing, and in particular to FIG. 1, there is shown a partially sectional view of one embodiment of an umbrella according to the present invention, generally designated by reference numeral 10. The umbrella 10 includes a handle 4, e.g. a Prince of Wales handle, formed with a socket 4*a* for receiving the lower extremity 1*b* of a hollow stick 1 which supports a canopy, generally designated by reference character 2. The canopy 2 includes in a conventional manner a plurality of ribs 11 which carry a fabric 12 and are jointly connected to respective ends of a plurality of struts 13. The ribs 11 have one end swingably mounted to an upper cap 3, and the rib-distant end of the struts 13 is swingably mounted to a crown 5 which is securely fixed to the stick 1. For ease of illustration, FIG. 1 shows only a schematical illustration of the canopy 2 with a single rib 11 and a single strut 13, with the left-hand side showing the canopy 2 in an open disposition and the right-hand side showing the canopy 2 in a closed disposition.

Received within the hollow stick 1 is a hollow shaft or slide element 14 which has an upper end received in the upper cap 3. The stick 1 and the slide element 14 thus form a telescopic assembly by which the canopy 2 can be moved between the open and closed positions.

The slide element 14 forms part of a slide mechanism which further includes a runner 6 traveling on the stick 1 and positioned in vicinity of the handle 4 within easy reach of one hand of a user. The runner 6 is secured to the slide element 14 by a pin 6*a* which extends perpendicular to the slide element 14 and is movably guided within an elongated slot 1*c* of the stick 1. The length of the slot 15 determines the distance of displacement of the slide element 14 within the stick 1 and of the runner 6.

The umbrella according to FIG. 1 is of the self-opening type, with the operation of the slide element 14 being effected by an elastic-driven mechanism in form of an elastic or rubber band 16 which is stretched between the slide element 14 and the stick 1 and is set under sufficient tension, when the canopy 2 of the umbrella 10 is closed, as shown on the right-hand side of FIG. 1 to bias the slide element 14 to seek the other end position. In the closed state, the slide element 14 is locked in place relative to the stick 1 by a pivotable latch 7 which is formed with a hook-like end that engages a slot 1*d* of the stick 1. The other end of the latch 7 is formed with an outwardly slanted push lever 7*a* which, when being pressed, disengages the hooked end of the latch 7 from the slot 1*d* to thereby release the energy stored in the elastic 16. Thus, the slide element 14 travels upwardly to open the canopy 2.

Figure 7:
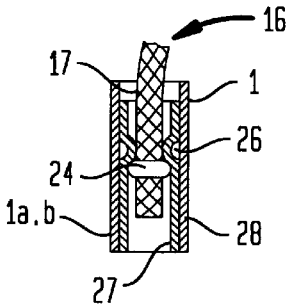
FIG. 7 is a fragmentary, enlarged sectional view of an elastic, illustrating in detail an exemplified attachment of one end of the elastic within the stick of an umbrella according to the present invention.

The elastic 16 is preferably made of an extremely stretchable, stable and slidable, multi-fiber latex rubber fabric in form of a rubber cable sheathed by a textile fabric, as indicated in FIG. 7. Alternatively, the elastic 16 may also be provided in the form of a hose-like latex structure. The elastic 16 is imparted with a permanent initial tension and is characterized by an ability to extend at application of a sufficient force up to eight times its length, by a light weight and a relatively narrow cross section even upon storage of a high force, and by a capability to change directions at a tight curve radius even in narrow spots of the stick 1, without adversely affecting the efficiency and stability of the umbrella 10.

The elastic 16 is secured on one end by the pin 6*a* to the slide element 14 and secured on its other end at an attachment point 1*e* to the stick 1 at the upper end 1*a* thereof, with the attachment point 1*e* being guided in a longitudinal slot 14*a* of the slide element 14 for displacement therein. In this configuration of the umbrella 10, the elastic 16 operates as opening mechanism by forcing the slide element 14 upwards relative to the stick 1 when releasing the runner 6 through actuation of the push lever 7*a*. The energy stored in the elastic 16 through manual closing of the umbrella 10 is released and forces the slide element 14 upwardly to occupy the open disposition of the canopy 2, as shown on the left-hand side of FIG. 1.

The effective lift of the elastic 16 corresponds to the travel path of the slide element 14 relative to the stick 1. Closing of the canopy 2 is effected by manually pulling down the runner 6 so that the slide element 14 is retracted in relation to the stick 1 and occupies the position as shown on the right-hand side of FIG. 1, with the elastic 16 being reset under tension for storing elastic energy.

Figure 2:
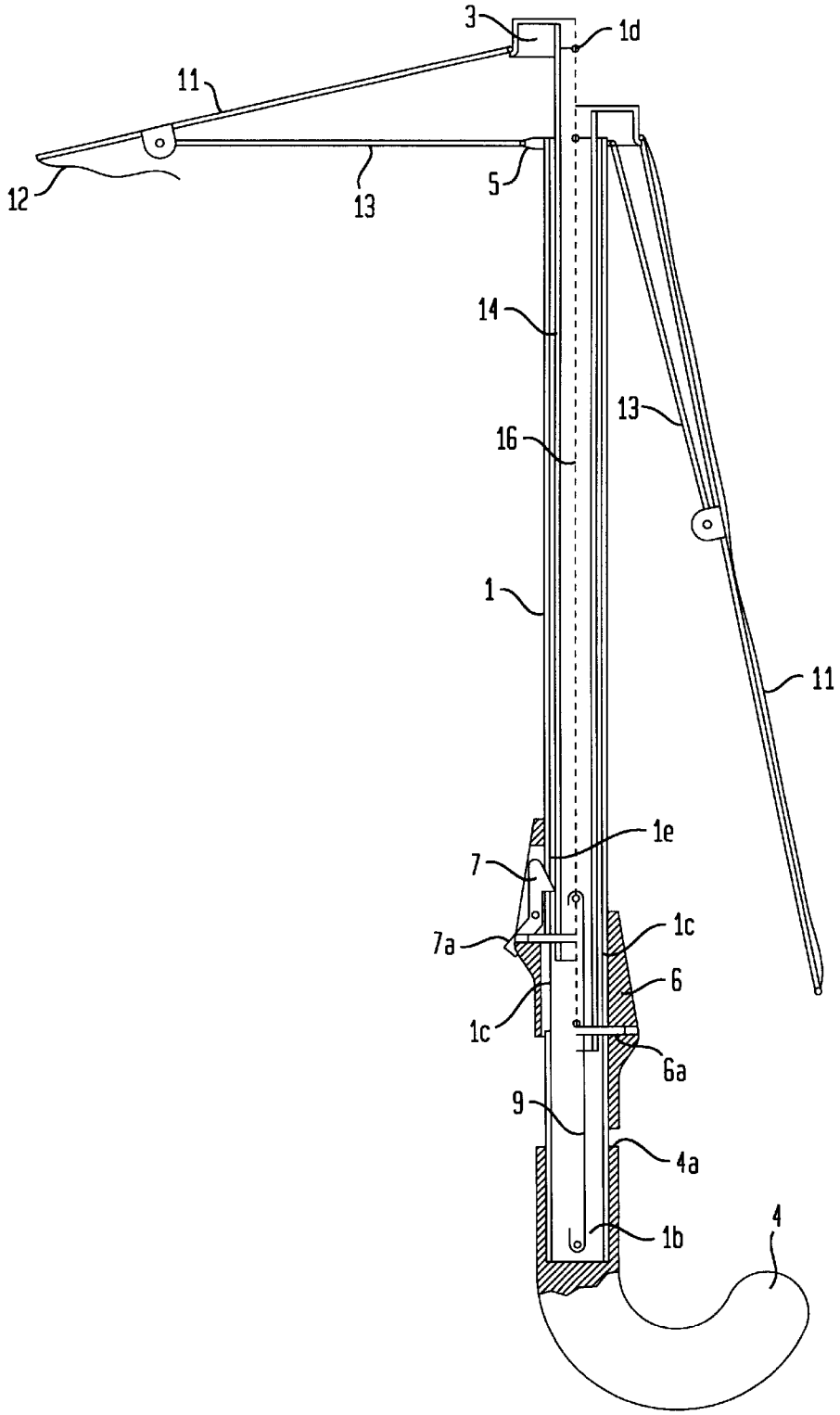
FIG. 2 is a partially sectional view of a second embodiment of an umbrella according to the present invention of the self-closing type, illustrating on the left hand side the umbrella with opened canopy and on the right hand side with closed canopy.

FIG. 2 shows a partially sectional view of another embodiment of an umbrella, generally designated by reference numeral 20, which is of the self-closing type. For ease of understanding, same reference numerals have been used for same elements as described with reference to FIG. 1. As shown in FIG. 2, the elastic 16 is secured with one extremity at the upper end of the slide element 14 at the attachment point 1*d* and with its other extremity via a hook 9 to the stick 1 at the lower end 1*b* thereof inside the socket 4*a* of the handle 4. Thus, the elastic 16 of the elastic-driven mechanism automatically closes the umbrella 20 by loading the slide element 14 to seek the lower disposition. In the open position of the canopy 2, the hooked end of the latch 7 locks onto the stick 1 to fix the slide element 14, as shown on the left-hand side of FIG. 2, with the elastic 16 being stretched and set under tension. Upon pressing the push lever 7*a*, the latch 7 is released so that the stored energy in the elastic 16 moves the slide element 14 downwards to close the canopy 2, as shown on the right-hand side of FIG. 2.

Figure 3:
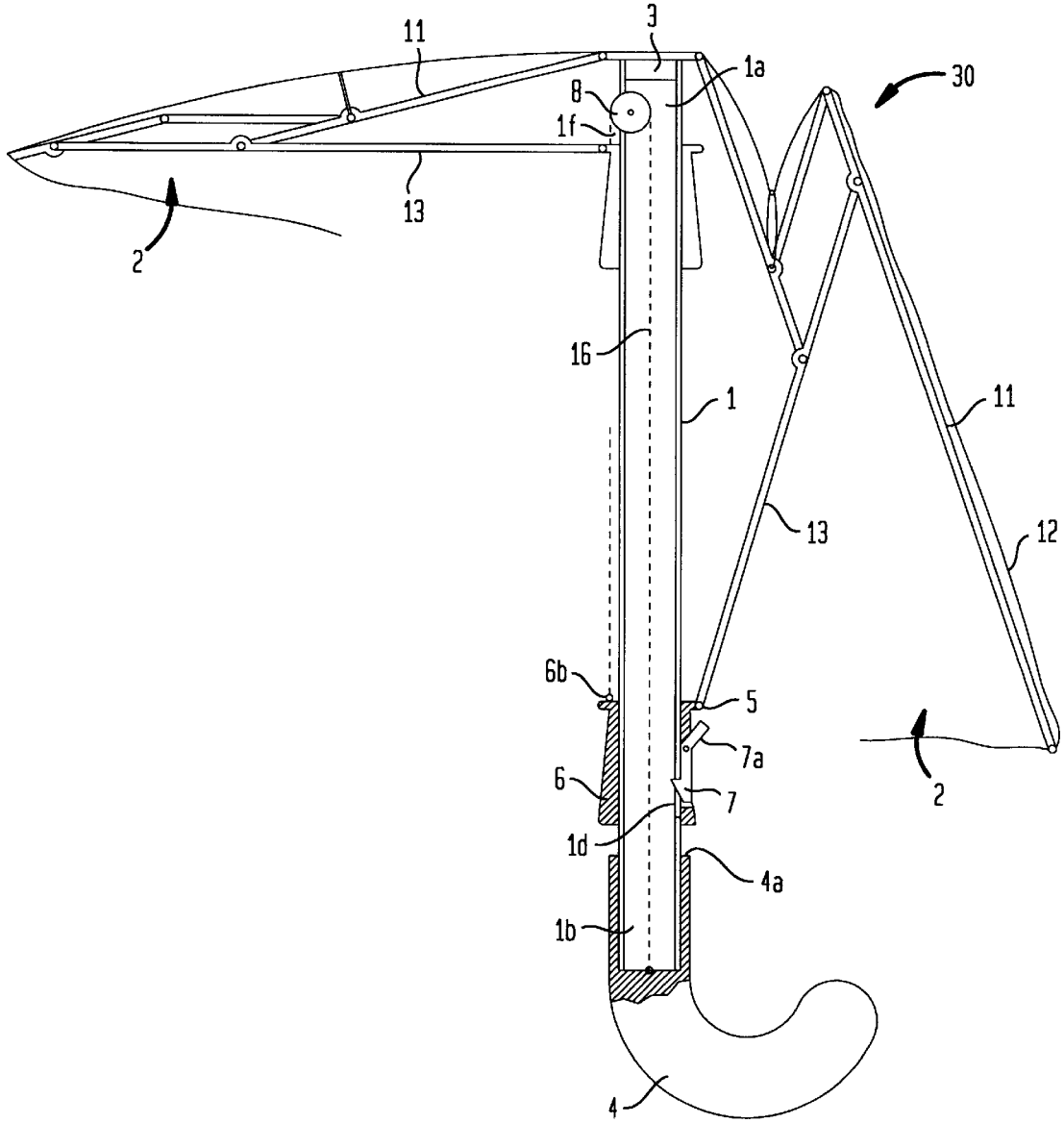
FIG. 3 is a partially sectional view of a third embodiment of an umbrella according to the present invention of the self-opening type, in open and closed positions of a collapsible canopy and exhibiting elastic-driven mechanism with reversing travel direction.

Turning now to FIG. 3, there is shown a partially sectional view of a further variation of an umbrella according to the present invention, generally designated by reference numeral 30. The elastic 16 of the elastic-driven mechanism is secured at one extremity to the lower end 1*b* of the stick 1 within the socket 4*a* of the handle 4 and secured with its other extremity to the runner 6 which travels externally on the stick 1. Positioned at the upper end 1*a* of the stick 1 is a pulley 8 which partially projects outwards through a slot 1*f* in the wall of the stick 1 to route the elastic 16 to the outside and to reverse the traveling direction of the elastic 16 for attachment to the runner 6 at attachment point 6*b*. The umbrella 30 is of the self-opening type, with the elastic 16 automatically moving the runner 6 from the closed position shown on the right-hand side of FIG. 3 into the open position of the canopy 2 shown on the left-hand side of FIG. 3. Closing of the umbrella 30 is effected by grasping the runner 6 with one hand and moving it downwards, so that the struts 13, which are rotatably secured to the runner 6, fold together with the ribs 11 and the fabric 12 to thereby collapse the canopy 2. The closed position of the canopy 2 is retained by locking the hooked end of the latch 7 onto the stick 1, as shown on the right-hand side of FIG. 3. The elastic 16 is thus suitably tensioned to store the required force for effecting the opening drive when releasing the latch 7 through actuation of the push lever 7*a*.

The effective working stroke of the elastic 16 of the umbrella 30 is extremely long and extends over the entire length of the stick 1. Despite the extreme working stroke, the elastic 16 remains hidden within the interior of the stick 1 when the canopy 2 occupies its opened position. In the closed disposition of the umbrella 30, the elastic 16 is exposed along the outside of the stick 1 over the entire length thereof but is basically hidden behind the canopy 2. It is however also possible to guide the exposed part of the elastic 16 within a longitudinal groove formed externally along the stick.

Despite the relatively tight curve radius for reversing the traveling direction of the elastic 16 via the pulley 8, the opening operation is effected in a forceful, silent and soft manner, and also the manual closing operation can be executed in a force-saving and soft manner through respective actuation of the runner 6.

Figure 4:
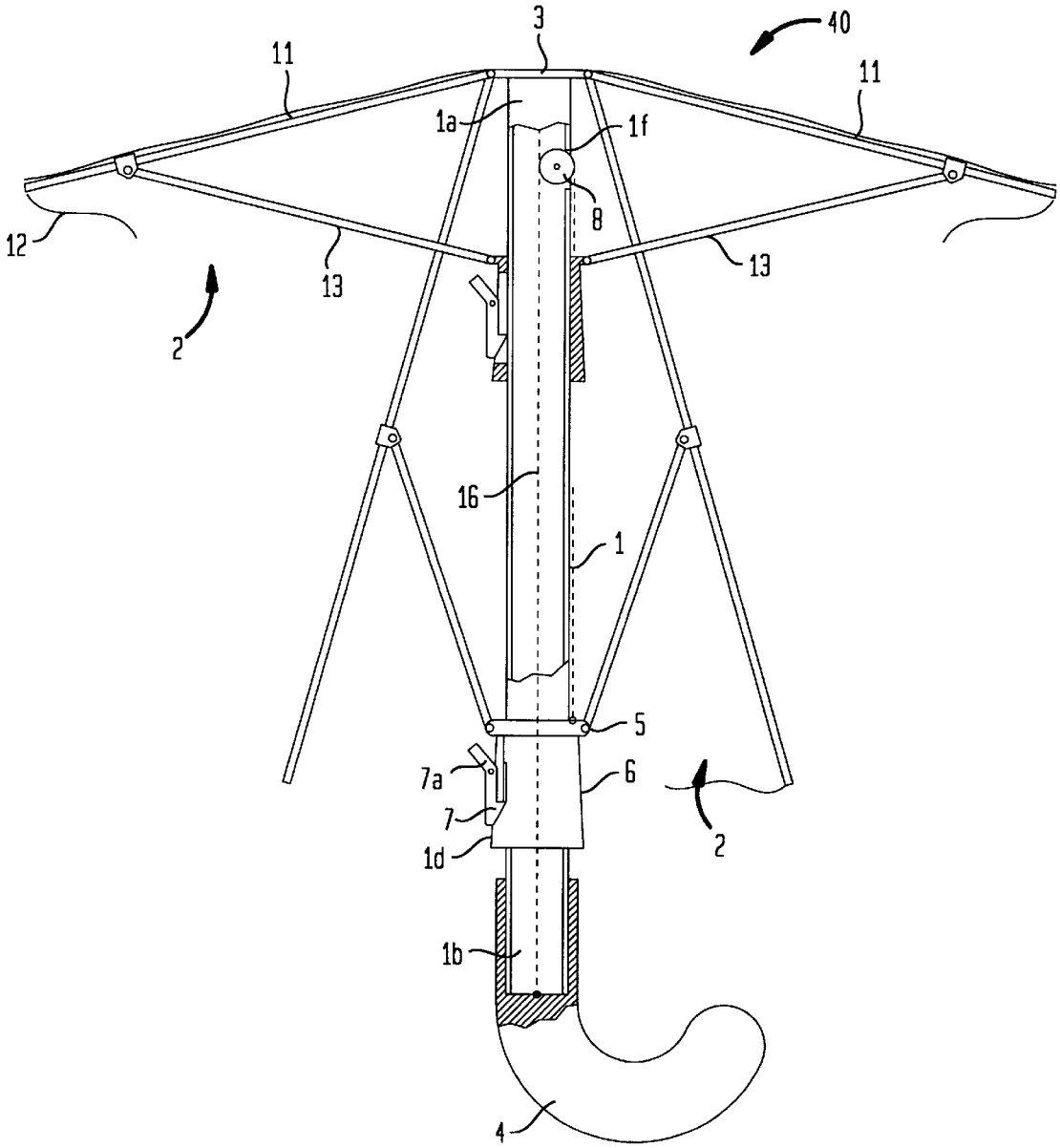
FIG. 4 is a partially sectional view of a variation of the self-opening umbrella of FIG. 3, illustrating on the left hand side the umbrella with opened, non-collapsible canopy and on the right hand side with closed canopy.

FIG. 4 shows a partially sectional view of a further variation of an umbrella, according to the present invention, and generally designated by reference numeral 40 which differs from the umbrella 30 only in the configuration of the canopy 2 which in contrast to the configuration according to FIG. 3 is not of the collapsible type but has a frame which only swings open and closes.

Figure 5:
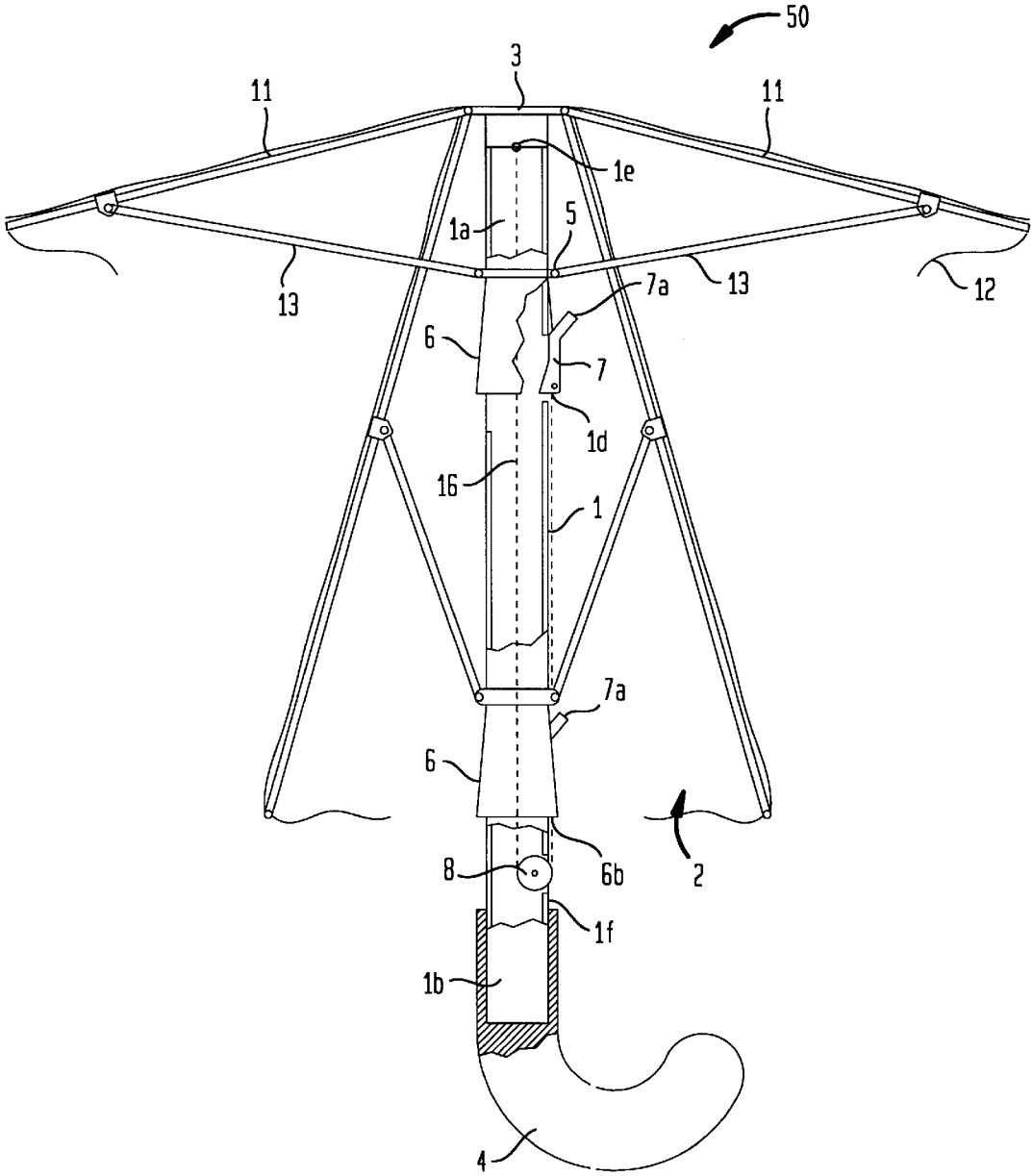
FIG. 5 is a partially sectional view of a fourth embodiment of an umbrella according to the present invention of the self-opening type, in open and closed positions of a canopy and exhibiting an elastic-driven mechanism with reversing traveling direction in proximity of the handle of the umbrella.

Turning now to FIG. 5, there is shown a partially sectional view of another variation of an umbrella according to the present invention, generally designated by reference numeral 50 and being of the self-closing type. For ease of understanding, again same reference numeral have been used for same or corresponding elements. The elastic 16 of the elastic-driven mechanism is secured with one extremity to the upper end of the stick 1 at a suitable attachment point 1*e*, e.g. to the upper cap 3, and is trained about pulley 8 which is situated near the handle 4 at the lower end 1*b* of the stick 1. The pulley 8 partially projects outwards through the slot 1*f* of the stick 1 to route the elastic 16 to the outside and to reverse the traveling direction of the elastic 16 for securement to the runner 6 at attachment point 6*b*.

The elastic 16 of the umbrella 50 also extends almost over the entire length of the stick 1 when the canopy 2 occupies the closed position and the runner 6 is in the lowermost position at the lower end 1*b* of the stick 1. In the open position of the canopy 2, the runner 6 occupies the uppermost position at the upper end 1*a* of the stick 1, with the elastic 16 being routed from the uppermost position of the runner 6 via the pulley 8 at the lower end 1*b* of the stick 1 and back to the uppermost position of the runner 6. The latch 7 locks in the open position of the canopy 2 onto the stick 1 so that the elastic 16 is stretched and set under tension to store the required energy for automatically closing the umbrella 50 upon release of the latch 7.

In order to render the exposed run of the elastic 16 as invisible as possible, the elastic 16 may be dyed in a same color as the stick 1 or, as described above, received in a longitudinal groove (not shown) on the outside of the stick 1. It is also conceivable, especially in order to configure the pulley 8 as inconspicuous as possible, to provide the exposed run of the elastic-driven mechanism in form of an extension string of tensile strength, e.g. a rope, plastic thread, steel wire or cord for attachment externally on the runner 6. When incorporating such a cord within an external longitudinal groove along the stick 1, the external portion of the elastic-driven mechanism with reversing travel direction via the pulley 8 can be visually optimized and configured for smooth running in an inconspicuous manner.

Figure 6:
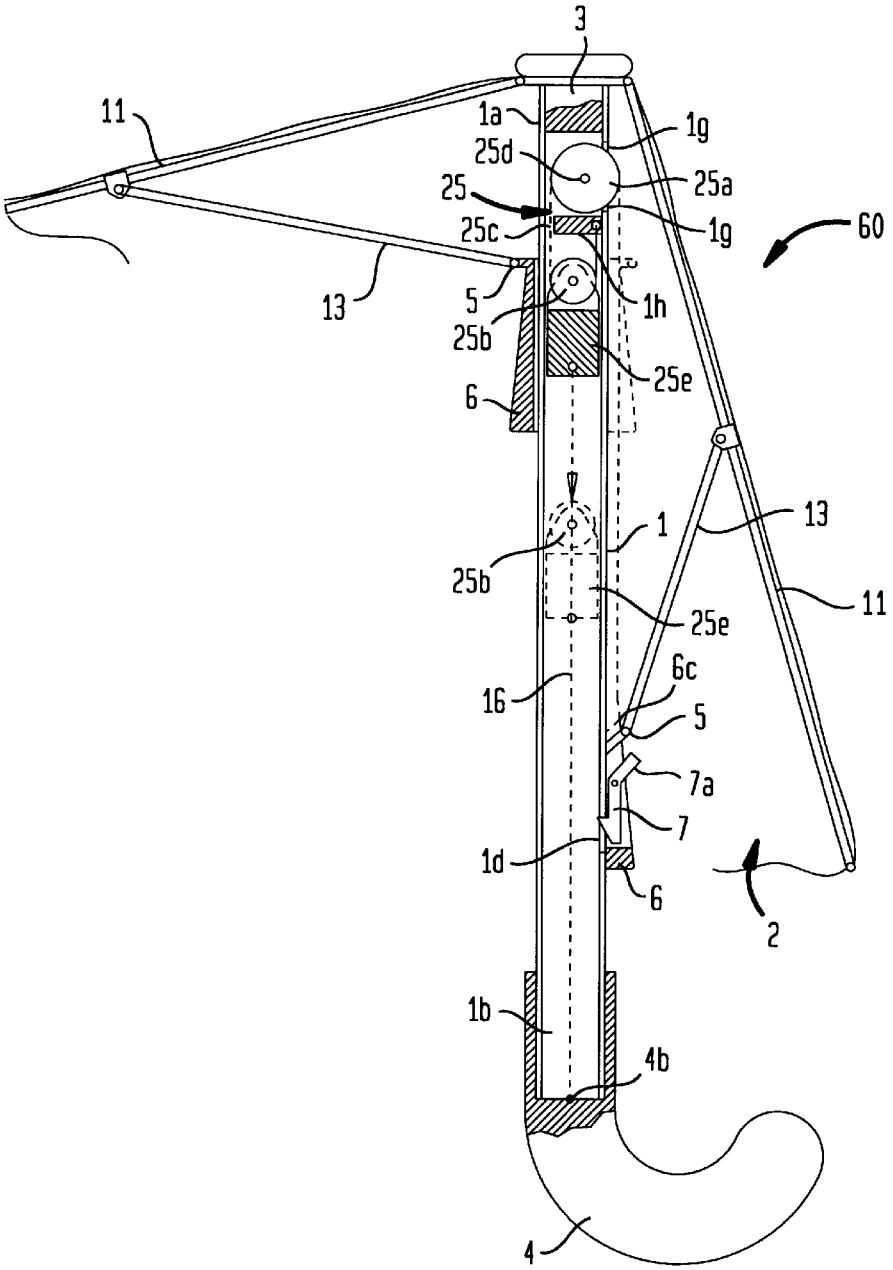
FIG. 6 is a partially sectional view of a fifth embodiment of an umbrella according to the invention of the self-opening type, illustrating on the left hand side the umbrella with opened canopy and on the right hand side with closed canopy, and exhibiting an elastic-driven mechanism in combination with transmission in form of a block and tackle.

FIG. 6 shows a partially sectional view of a further embodiment of an umbrella according to the present invention, generally designated by reference numeral 60. The umbrella 60 is of the self-opening type and includes a reduction gear, generally designated by reference numeral 25 and preceding the elastic-driven mechanism for cooperation therewith. The reduction gear 25 is incorporated within the stick 1 at its upper end 1*a* and provided in the form of a block and tackle with two pulleys 25*a*, 25*b* and a rope 25*c* so that the force application by the elastic 16 can be advantageously reduced according to the reduction ratio of the reduction gear 25. The upper pulley 25*a* is rotatably mounted to the stick 1 for rotation about a rotational axis 25*d*, which is supported by the stick 1, and partially projects outwards through an opening 1*g* in the wall of the stick 1. The lower pulley 25*b* is geared down at a reduction ratio of 1:2 relative to the upper pulley 25*a* and is rotatably mounted on a guide member 25 *e* of the reduction gear 25. The guide member 25*e* is suited to the hollow profile of the stick 1 and slides therein. The rope 25*c* of the reduction gear 25 is secured at one extremity to a cantilever 1*h* which is mounted to the stick 1. The other extremity of the rope 25*c* is secured to the runner 6 at attachment point 6*c*. The rope 25*c* thus runs from the cantilever 1*h* via the pulley 25*b* and pulley 25*a* to the outside through slot 1*g* and to the runner 6. The pulley 25*a* thus assumes also a dual function as a reversing pulley in a same manner as the previously described pulley 8.

The reduction gear 25 which precedes the elastic 16, forms a block and tackle that extends the elastomer-drive mechanism to the runner 6. The elastic 16 is secured at one extremity to the guide member 25*e* and at its other extremity to attachment point 4*b* inside the socket 4*a* for the stick 1.

The umbrella 60 is closed by manually grasping the runner 6 and pulling the runner 6 downwards into the position shown on the right-hand side of FIG. 6 in which the canopy 2 is closed. During the downward motion of the runner 6, the rope 25*c* is pulled downwards along the stick 1 so that the guide member 25*e* within the stick 1 is pushed upwards into the position shown in solid line to set the elastic 16 under tension. The runner 6 is locked onto the stick 1 by the hooked end of the latch 7. When pressing onto the push lever 7*a*, the latch 7 is disengaged so that the elastic 16 moves downwards to pull thereby the runner 6 upwards. At the same time, the canopy 2 unfolds into the open position, with the rope 25*c* being wound onto the pulleys 25*a*, 25*b* inside the stick 1 while the guide member 25*e* moves in unison with the pulley 25*b* downwards within the stick 1 into the position as shown by dash-dot line. In the open position, the elastic 16 is relieved to its initial extent of tension.

Person skilled in the art will understand that the combined elastic 16 and reduction gear drive 25 may be used in the same manner as a self-closing mechanism by simply reversing the described configuration, so that the reduction gear is positioned at the lower end 1*b* of the stick 1 and the elastic 16 is secured at the upper end of the stick 1 to the runner 6. Thus, the runner 6 seeks the closing position when the latch 7 locks onto the stick 1 in open position of the canopy.

Persons skilled in the art will understand that the above-described elastic-driven mechanism can be incorporated also in conventional double locking and releasing configurations for use in automatic umbrellas of the self-opening and self-closing type.

Referring now to FIG. 7, there is shown an schematic, exemplified illustration of one end of the elastic 16 to show generally an attachment of the ends of the elastic 16, by way of example with regard to the stick 1. It will be understood that, depending on the type of umbrella, the attachment of the ends of the elastic 16 to the slide element 14, upper cap 3, or the runner 6 can be effected in a same manner. As shown in FIG. 7, a squeeze ring 24 is press fitted onto the free end of the elastic 16 and bears against a crimped ledge or constriction 26 formed on a sleeve 27 which is press-fitted in the end of the stick 1 and placed over the end of the elastic 16. The sleeve 26 is formed with a flange 28 which rests against the axial end of the stick 1 for support.

While the invention has been illustrated and described as embodied in a self-opening and/or self-closing umbrella, it is not intended to be limited to the details shown since various modifications and structural changes may be made without departing in any way from the spirit of the present invention.

What is claimed as new and desired to be protected by Letters Patent is set forth in the appended claims:

We claim:

1. An umbrella, comprising:

a handle;

a canopy;

an elongated stick for connecting the handle and the canopy;

a slide mechanism linked to the canopy;

an elastomer-driven mechanism for controlling operation of the canopy between an open end position and a closed end position by moving the slide mechanism relative to the stick, said elastomer-driven mechanism being set under tension when the canopy occupies one of the end positions to bias the slide mechanism so that the canopy seeks the other end position; and a latching means for releasably locking the slide mechanism when the canopy occupies the one end position.

2. The umbrella of claim 1 wherein the elastomer-driven mechanism includes an elastic made of a multi-fibrous latex-rubber fabric in form of a rubber cable sheathed by a textile fabric.

3. The umbrella of claim 1 wherein the elastomer-driven mechanism includes an elastic provided in the form of a hose-like latex structure.

4. The umbrella of claim 1 wherein the elastomer-driven mechanism includes an elastic extending within the stick and having one extremity secured to one end of the stick and another extremity secured to the slide mechanism.

5. The umbrella of claim 1 wherein the slide mechanism includes a slide element extending within the stick to form with the stick a telescopic arrangement, with the elastomer-driven mechanism including an elastomer band extending within the stick and stretched between the stick and the slide element.

6. The umbrella of claim 1 wherein the slide mechanism includes a runner movable outside along the stick, said elastomer-driven mechanism including an elastomer band and a pulley which is positioned at one end of the stick, said elastomer band being stretched between the other end of the stick and the runner via the pulley.

7. The umbrella of claim 1, and further comprising a reduction gear in form of a block and tackle with a rope and pulleys for cooperation with the elastomer-driven mechanism, said slide mechanism including a runner movable outside along the stick, said elastomer-driven mechanism including an elastic stretched between the stick and the runner via the reduction gear and having one extremity secured to a first one of the pulleys and another extremity secured to one end of the stick, with the first pulley being positioned at the other end of the stick and traveling within the stick during operation of the elastic for moving the canopy between the open and closed positions.

8. The umbrella of claim 7 wherein the reduction gear includes a second pulley securely fixed to the stick and effecting a change of direction of the rope from inside the stick to an attachment point at the runner, with the first pulley being geared down in relation to the second pulley.

9. The umbrella of claim 6 wherein the elastomer band is formed with a prolongation in form of a rope or thread exhibiting tensile strength for connecting the elastic from the pulley to the runner.

10. The umbrella of claim 1, wherein the elastomer-driven mechanism includes an elastomer band, and further comprising attachment means for securement of a free end of the elastomer band, said attachment means including a sleeve received within the stick and formed with a crimped ledge, and a squeeze ring press-fitted in close proximity of the free end onto the elastomer band and bearing against the crimped ledge.

11. The umbrella of claim 1 wherein the latching means includes a latch with a hooked end for locking onto the stick when the canopy occupies the one end position, and a push-lever for enabling a disengagement of the hooked end from the stick.

* * * * *